US011885144B2

(12) United States Patent
Carlson

(10) Patent No.: US 11,885,144 B2
(45) Date of Patent: Jan. 30, 2024

(54) DRYWALL REPAIR APPARATUS AND METHOD

(71) Applicant: Gregory Carlson, Owens Cross Roads, AL (US)

(72) Inventor: Gregory Carlson, Owens Cross Roads, AL (US)

( * ) Notice: Subject to any disclaimer, the term of this patent is extended or adjusted under 35 U.S.C. 154(b) by 392 days.

(21) Appl. No.: 17/370,501

(22) Filed: Jul. 8, 2021

(65) Prior Publication Data

US 2022/0010572 A1 Jan. 13, 2022

Related U.S. Application Data

(60) Provisional application No. 63/050,084, filed on Jul. 9, 2020.

(51) Int. Cl.
*E04G 23/02* (2006.01)
*E04F 21/16* (2006.01)

(52) U.S. Cl.
CPC ..... *E04G 23/0203* (2013.01); *E04F 21/16* (2013.01)

(58) Field of Classification Search
CPC ... E04G 23/0203; E04G 23/0207; E04F 21/16
See application file for complete search history.

(56) References Cited

U.S. PATENT DOCUMENTS 3,717,970 A * 2/1973 Rosenblum ..... E04G 23/0203 52/514
4,062,165 A * 12/1977 Marks ..... E04G 23/0203 52/514
4,285,183 A 8/1981 Condit
4,460,420 A * 7/1984 Estrada ..... E04G 23/0203 52/514
5,299,404 A * 4/1994 Jabro ..... E04G 23/0207 52/514
5,353,568 A * 10/1994 Silva ..... E04G 23/0207 52/514
5,556,688 A * 9/1996 Cox ..... E04G 23/0203 52/514
5,960,603 A 10/1999 Redden et al.
6,071,833 A * 6/2000 D'Alisa ..... E04G 23/0203 428/350
6,247,283 B1 * 6/2001 Slabaugh ..... E04F 21/02 52/514
6,347,496 B1 2/2002 Pinkins
6,378,263 B1 * 4/2002 Sobers ..... E04G 23/0203 52/712

(Continued)

FOREIGN PATENT DOCUMENTS

EP 1617014 A1 1/2006

*Primary Examiner* — Rodney Mintz
(74) *Attorney, Agent, or Firm* — Dunlap Bennett & Ludwig, PLLC

(57) ABSTRACT

A drywall repair apparatus and method. The apparatus includes a plastic puck that is dimensioned to fill a hole in damaged drywall. The apparatus is anchored inside the wall. The apparatus may have an integrated plastic puck mounted on a plastic plank. The device mounts inside the wall and the puck fills the ½" deep void, leaving only 1/16" to be filled with joint compound. There is no time-consuming multiple layering required. There is no need for broad feathering to hide the repair and the repair is as solid as the original wall before damage.

10 Claims, 4 Drawing Sheets

(56) References Cited

U.S. PATENT DOCUMENTS

| | | | | |
|---|---|---|---|---|
| 6,594,967 | B1 * | 7/2003 | Panahii | E04G 23/0203 52/514 |
| 6,797,354 | B2 * | 9/2004 | Fleck | E04G 23/0207 428/317.1 |
| 7,703,255 | B1 * | 4/2010 | Norrid | E04G 23/0203 52/514 |
| 8,024,903 | B2 * | 9/2011 | Riggs | E04G 23/0203 52/514 |
| 8,615,949 | B2 * | 12/2013 | Georgievski | E04G 23/0203 52/514 |
| D700,814 | S | 3/2014 | Imamura | |
| 10,145,132 | B2 | 12/2018 | Wagner | |
| 10,704,280 | B2 * | 7/2020 | Butler | E04G 23/0207 |
| 2002/0102381 | A1 * | 8/2002 | McClurg | E04G 23/0203 428/63 |
| 2003/0228438 | A1 * | 12/2003 | Fleck | E04G 23/0207 428/343 |
| 2006/0010817 | A1 * | 1/2006 | Shull | E04G 23/0203 52/514 |
| 2006/0101765 | A1 | 5/2006 | Bailey | |
| 2009/0084062 | A1 * | 4/2009 | Riggs | E04G 23/0203 52/741.4 |
| 2011/0107705 | A1 * | 5/2011 | Georgievski | E04G 23/0203 52/514 |
| 2016/0208506 | A1 * | 7/2016 | Butler | E04G 23/0207 |
| 2017/0138073 | A1 * | 5/2017 | Hackley | E04G 23/0207 |
| 2018/0305942 | A1 * | 10/2018 | Wagner | E04G 23/0203 |
| 2019/0100931 | A1 * | 4/2019 | Rodriguez | E04G 23/0207 |

* cited by examiner

DRYWALL REPAIR APPARATUS AND METHOD

CROSS-REFERENCE TO RELATED APPLICATION

This application claims the benefit of priority of U.S. provisional application No. 63/050,084 filed Jul. 9, 2020, the contents of which are herein incorporated by reference.

BACKGROUND OF THE INVENTION

The present invention relates to drywall, and more particularly to apparatus and methods for repairing holes in drywall.

Repair of drywall is typically performed by applying a drywall mud, or patch compound, in the hole to perform a patch repair. However, for larger holes, this often requires multiple applications of the drywall mud while permitting the mud an opportunity to completely dry between applications, causing unnecessary delays in performing a simple repair.

Even when properly dried, mud applications to larger holes often do not have sufficient structural integrity because the mud does not have a suitable bonding interface with the drywall and there is often an absence of wall structural support behind the mud. Consequently, the patch may release from the drywall when the patch is sanded for a smooth wall surface prior to refinishing or when moistened with the paint during refinishing.

Other drywall repair products provide a fibrous patch that is affixed to the outside surface of the drywall. The finished repair is not solid as there is no backing behind the fibrous patch. Also, because the patch adds elevation to the drywall surface, this increases the area needed to feather the repair so that it blends into the wall. Feathering is a professional drywall technique that most homeowners are not able to do well, resulting in a subpar repair.

Some other types of drywall repair devices mount to inside of the drywall, creating a solid backing but do not fill the ½" deep void created by the hole. The void needs to be filled with multiple ⅛" layers of joint compound each of which, as indicated previously, must dry before the next layer is applied. Drying time between layers is approximately 4 hours. Thus, four ⅛" layers will take 16 hours to complete the repair.

As can be seen, there is a need for improved apparatus and methods for performing a drywall repair.

SUMMARY OF THE INVENTION

In one aspect of the present invention, a drywall repair device, for repairing a hole in a drywall panel is disclosed. The drywall repair device includes an elongate plank having a front surface, a back surface, a first end, a second end, and a point defined at one of the first end and the second end. A cylindrical puck has a top surface elevated from the front surface. The cylindrical puck has a diameter corresponding with a width of the elongate plank. A tensioner is removably coupled to the cylindrical puck. The tensioner is adapted to apply a tension to the top surface of the cylindrical puck to retain the drywall repair device in the hole in the drywall panel.

In some embodiments, the diameter is selected to correspond with a size of the hole to be repaired.

In some embodiments, the top surface is elevated at a height that is approximately ⅛ inch less than a thickness of the drywall panel.

In some embodiments, the device also includes an aperture defined in the top surface of the cylindrical puck. The tensioner is removably received in the aperture. The tensioner may be a cable.

In other embodiments, a beveled edge is defined along a side edge of the point.

In other aspects of the invention, a method of repairing a hole in a drywall panel is disclosed. The method includes inserting a drywall repair device into the hole in the drywall panel. The drywall repair device has a point defined at a first end of an elongate plank having a front surface, a back surface. A cylindrical puck has a top surface elevated from the front surface and has a diameter corresponding with a width of the elongate plank. The cylindrical puck is positioned in the hole by manipulating a tensioner removably coupled to the cylindrical puck. At least the first end of the elongate plank is secured to an interior surface of the drywall panel with a fastener extending through a front surface of the drywall panel.

In some embodiments, the method includes removing the tensioner from the cylindrical puck.

In some embodiments, the method also includes applying a drywall compound to an exterior surface of the drywall panel surrounding the hole to cover the top surface of the cylindrical puck and the fastener.

In other embodiments, an outward tension is applied to the tensioner to retain the drywall repair device in the hole while securing the fastener.

In yet other embodiments, the method includes cleaning and sizing the hole by inserting the point extending from a front end of the elongate plank into the hole. The elongate plank is rotated about a longitudinal axis while urging the elongate plank into the hole until the hole has a width corresponding to a width of the elongate plank.

These and other features, aspects and advantages of the present invention will become better understood with reference to the following drawings, description, and claims.

DETAILED DESCRIPTION

Figure 1:
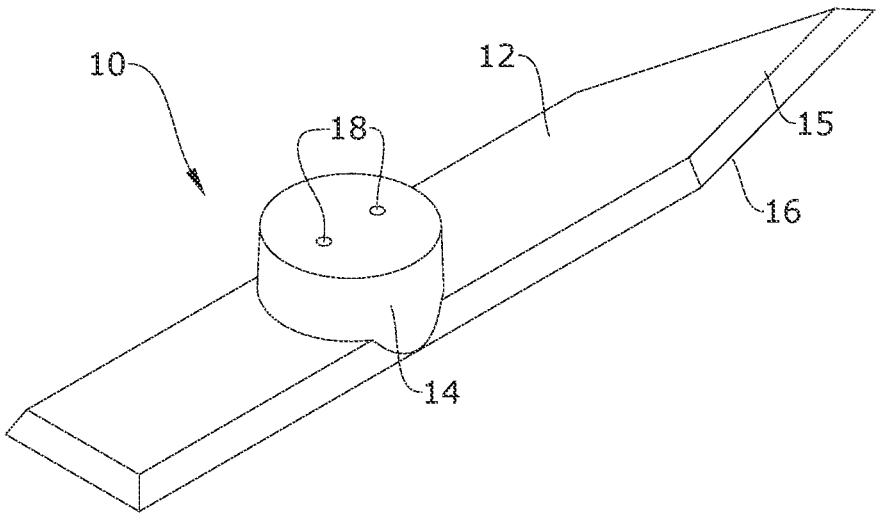
FIG. 1 is a perspective view of the drywall repair device.
Figure 2:
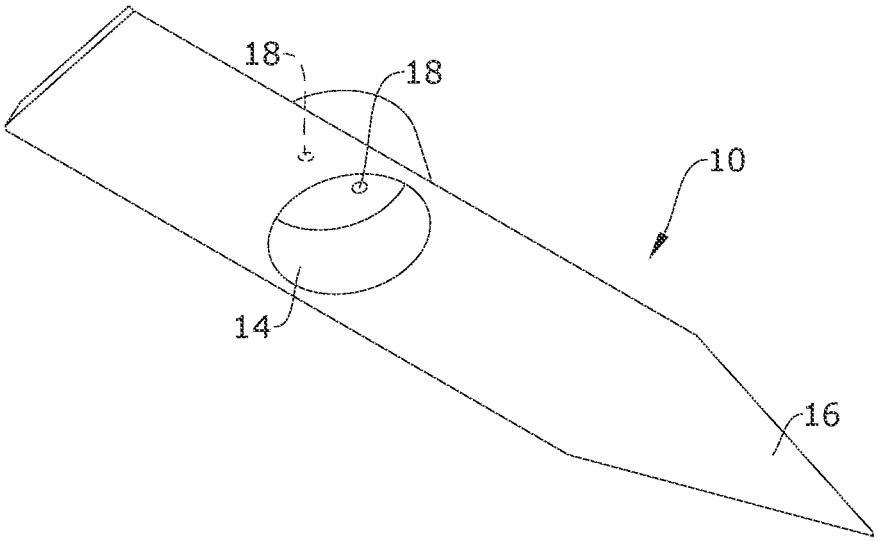
FIG. 2 is a perspective view of the drywall repair device showing the bottom side.
Figure 3:
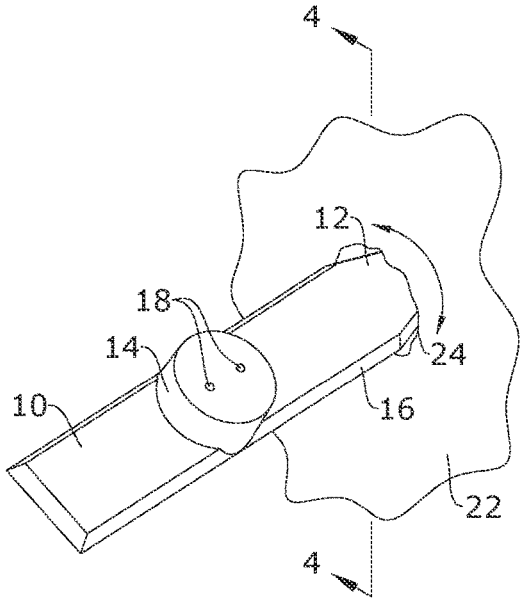
FIG. 3 is a perspective view of the drywall repair device showing a hole sizing.
Figure 4:
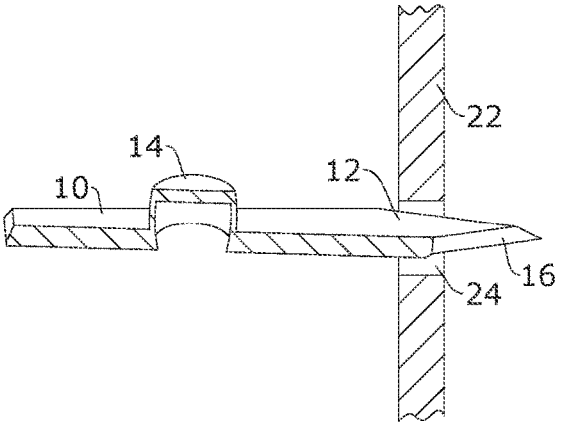
FIG. 4 is a section view of the drywall repair device, taken along line 4-4 in FIG. 3.

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provides a puck and plank drywall repair device that can be installed in less than two minutes. More importantly, the drywall repair device requires only one layer of joint compound to conceal the repair in the wall surface and does not require broad feathering technique to hide the repair site.

As seen in reference to the drawings, the drywall repair device 10 that includes an elongate plank portion 12 and a cylindrical puck portion 14 protruding from a surface of the plank 12. Preferably the cylindrical puck 14 is positioned along an intermediate portion of the plank 12. At least one end of the plank 12 includes a pointed tip 15. The pointed tip 15 may also include a beveled edge surface 16. The pointed end 15 and beveled edge 16 are configured to clean and size the hole in the drywall 22 as part of the repair process.

The plank 12 has a lateral width that corresponds with a diameter of the puck 14 and a size of hole to be repaired. The elevation of the puck 14 from the surface of the plank 12 is selected to position the top front face of the puck 14 at a depth of ⅛ inch from a front surface of the drywall 22. Accordingly, the elevation of the puck 14 may be ⅛ inch less than a thickness of the drywall 22 that is in need of repair, more preferably 1/16". The drywall repair device 10 can be made of any suitable materials, such as plastics, wood, composites, and the like.

One or more apertures 18 are defined in a top face of the puck 14. The apertures are configured to receive a tensioner 20. The tensioner 20 is removably coupled to the puck 14. The tensioner 20 is adapted to retain the drywall repair device 10 against an inner surface of the drywall 22 such that a fastener 26 may be received in the plank 12. In the non-limiting embodiment shown, the tensioner 20 may be a cable 20 that allows the user to position the drywall repair device 10 in the hole during installation.

A method of repairing a hole in a drywall surface is illustrated in FIGS. 3-13. In a first step, the pointed tip 15 is utilized to clean and size a hole or other damage in a drywall sheet 22. A distal end of the tip 15 is inserted into the hole and the drywall repair device 10 is rotated back and forth along a longitudinal axis of the plank 12. As the drywall repair device 10 is rotated, the beveled edge 16 scrapes the drywall material. The drywall repair device 10 is progressively urged into the hole to be repaired until the hole has been sized to the lateral width of the plank 12.

Figure 5:
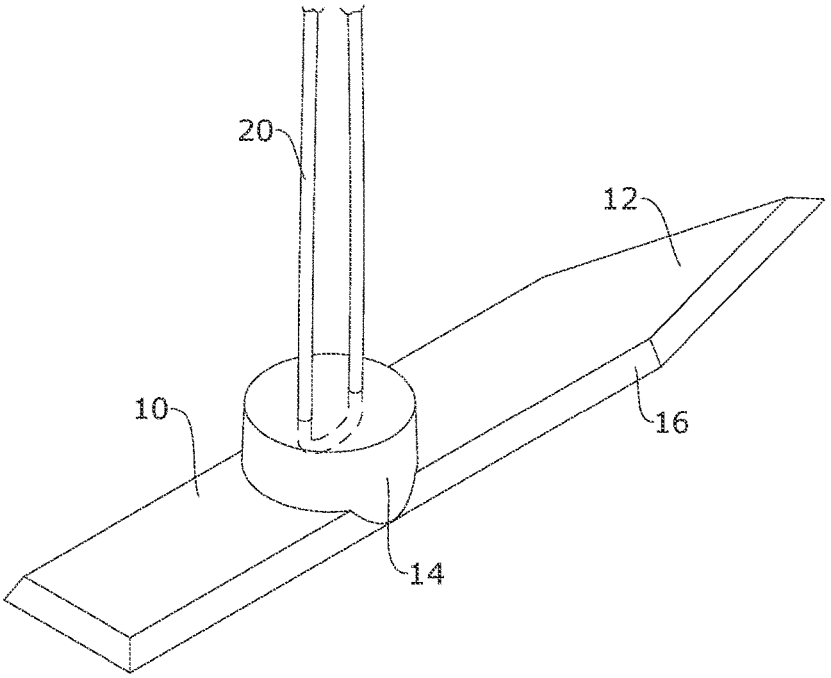
FIG. 5 is a perspective view of the drywall repair device showing a cable.

The cable 20 may then be routed through the apertures 18 to prepare the drywall repair device 10 for installation in the wall. The cable 20 is routed so that free ends of the cable 20 protrude from the outer face of the puck 14 and the cable 20 is retained against an interior surface of the puck 14, such as seen in FIG. 5.

Figure 6:
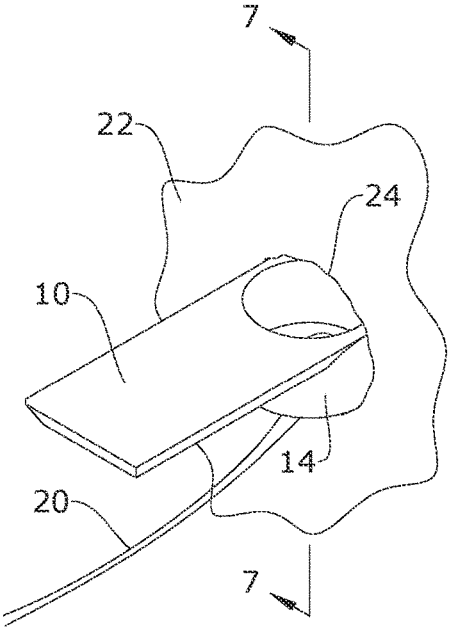
FIG. 6 is a perspective view of the drywall repair device showing it being placed in position behind the drywall.
Figure 7:
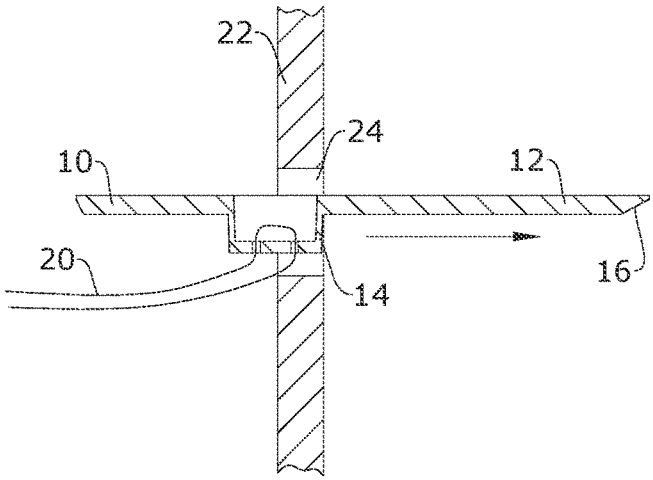
FIG. 7 is a section view of the drywall repair device, taken along line 7-7 in FIG. 6.

The drywall repair device 10 may then be inserted into the cleaned and sized hole 24 in the drywall 22. While the drywall repair device 10 is inserted into the cleaned and sized hole 24 the user utilizes the free ends of the cable 20 to prevent the drywall repair device 10 from falling into the cavity behind the wall surface 22, as seen in FIGS. 6 and 7.

Figure 8:
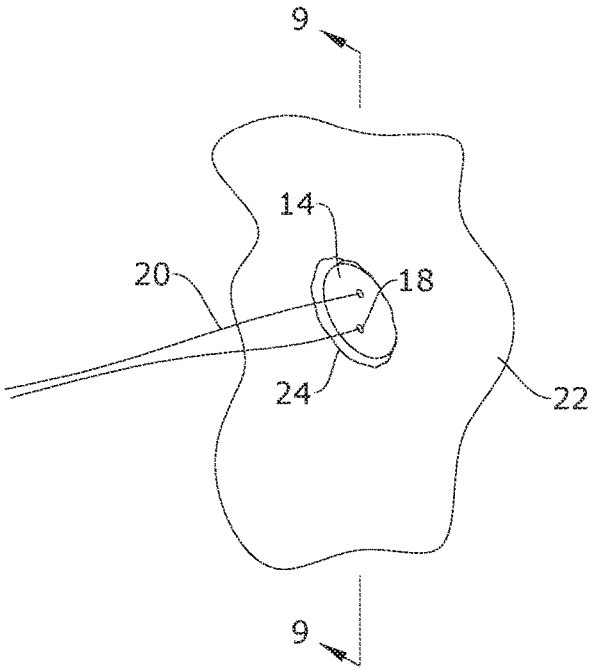
FIG. 8 is a perspective view of the drywall repair device showing it being positioned behind the drywall.
Figure 9:
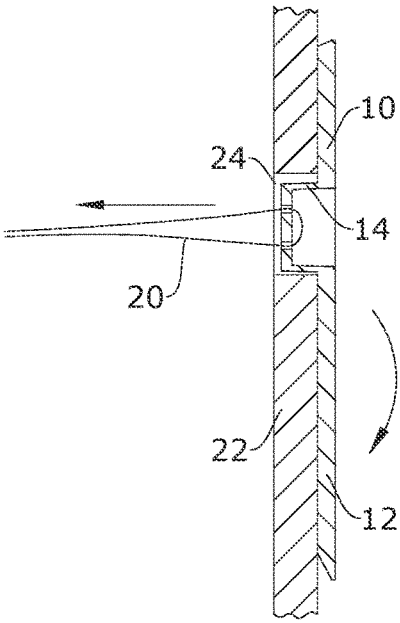
FIG. 9 is a section view of the drywall repair device, taken along line 9-9 in FIG. 8.

Once the drywall repair device 10 is positioned within the cavity, the cable 20 is drawn to position the puck 14 within the cleaned and sized hole 24, as shown in FIG. 8. Tension is applied to the cable 20 to retain the plank 12 in abutment with an interior surface of the drywall 22 surrounding the cleaned and sized hole 14, as shown in FIG. 9.

While tension is applied to the cable 20, a drywall fastener 26 is drilled through the drywall 22 and into the ends of the plank 12. The drywall fastener 26 is tightened to retain the plank 12 in position in abutment with the interior surface of the drywall 22 with the puck 14 positioned within, and preferably centered in the cleaned and sized hole 24, as shown in reference to FIGS. 10 and 11.

Figure 10:
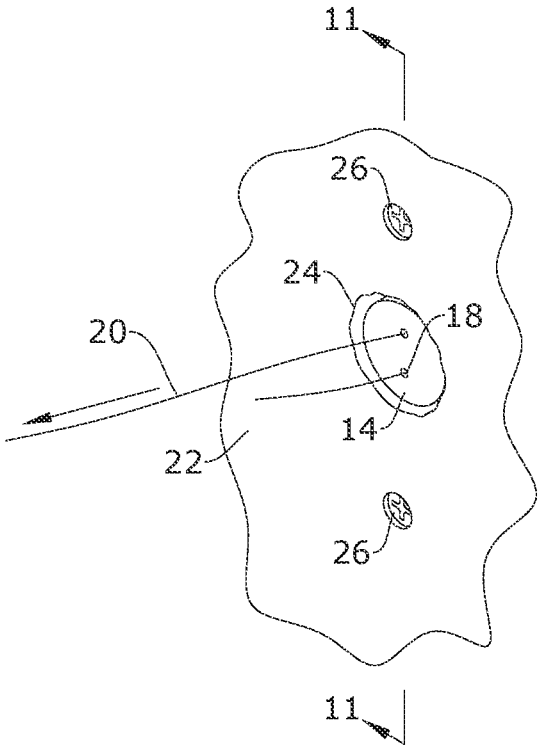
FIG. 10 is a perspective view of the drywall repair device being secured in the hole with a drywall screw.
Figure 11:
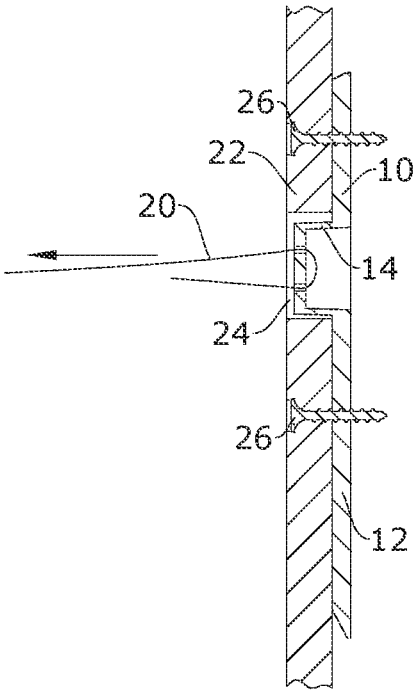
FIG. 11 is a section view of the drywall repair device, taken along line 11-11 in FIG. 10.

Once the drywall repair device 10 has been secured with the fastener 26, the user may then withdraw the cable 20 from the apertures 18 in the puck 14 as shown in FIGS. 10 and 11. In the embodiment shown, a free end of the cable 20 is pulled to withdraw the cable from the puck 20. Alternatively, the free end of the cable 20 may be pushed within the interior cavity behind the wall 22.

Figure 12:
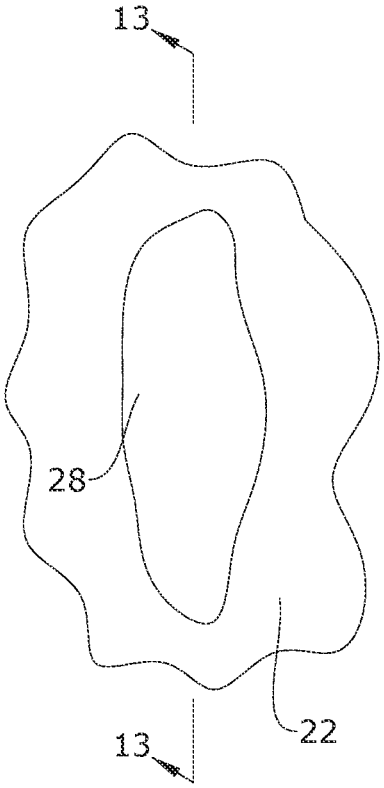
FIG. 12 is a perspective view of the drywall repair device showing the spackling application.
Figure 13:
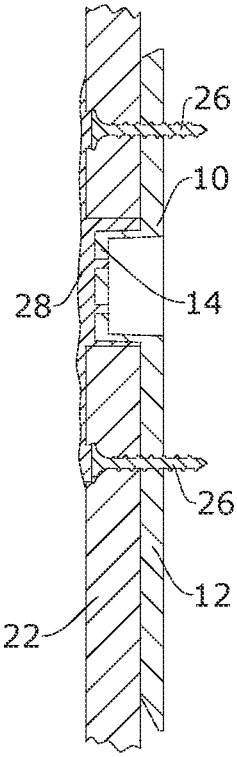
FIG. 13 is a section view of the invention, taken along line 13-13 in FIG. 12.

As seen in FIGS. 12 and 13, the user may apply a drywall compound 28 to the surface of the drywall 22, covering the fastener 26 and filling the cleaned and sized hole 24. A stronger bond may be achieved by pressing the drywall compound 28 such that it is urged into the aperture 18.

Unlike other repair devices/techniques, this integrated device is both a tool for preparing the hole and an integral part of the finished repair. The puck fills the drywall hole, eliminating the need for numerous layers of joint compound to fill the ½" void created by the hole. Because the puck and plank are a single plastic device, the plank is anchored to the inside of the drywall, thereby holding the puck in place. The device reduces the number of joint compound layers required, eliminates the need for professional technique of broad feathering around the hole to hide the repair. It also, provides a solid backing inside the drywall that is hidden and results in a long lasting and strong repair It should be understood, of course, that the foregoing relates to exemplary embodiments of the invention and that modifications may be made without departing from the spirit and scope of the invention as set forth in the following claims.

What is claimed is:

1. A drywall repair device, for repairing a hole in a drywall panel, comprising:

a unitary elongate plank of one-piece construction having a front surface, a back surface, a first end, a second end, a point defining one of the first end and the second end and a beveled edge located along a side edge of the point;

a cylindrical puck integrally positioned along an intermediate portion of the plank, the cylindrical puck having a top surface with an aperture defined therein, the top surface elevated from the front surface of the plank, the cylindrical puck having a diameter corresponding with a width of the elongate plank; and a tensioner removably received in the aperture of the cylindrical puck, the tensioner configured to apply a tension to the top surface of the cylindrical puck to retain the drywall repair device in the hole in the drywall panel.

2. The drywall repair device of claim 1, wherein the diameter is selected to correspond with a size of the hole to be repaired.

3. The drywall repair device of claim 1, wherein the top surface is elevated at a height that is approximately ⅛ inch less than a thickness of the drywall panel.

4. The drywall repair device of claim 1, wherein the tensioner is a cable.

5. A method of repairing a hole in a drywall panel, comprising:

providing the drywall repair device of claim 1;

inserting the drywall repair device into the hole in the drywall panel;

positioning the cylindrical puck in the hole by manipulating the tensioner removably received in the aperture of the cylindrical puck; and securing at least the first end of the elongate plank to an interior surface of the drywall panel with a fastener extending through a front surface of the drywall panel.

6. The method of claim 5, further comprising:

applying an outward tension to the tensioner to retain the drywall repair device in the hole while securing the fastener.

7. The method of claim 5, further comprising:

cleaning and sizing the hole by inserting a point extending from a front end of the elongate plank into the hole;

rotating the elongate plank about a longitudinal axis and urging the elongate plank into the hole until the hole has a width corresponding to a width of the elongate plank.

8. The method of claim 5, further comprising:

securing the second end of the elongate plank to an interior surface of the drywall panel with a fastener extending through a front surface of the drywall panel.

9. The method of claim 5, further comprising:

removing the tensioner from the cylindrical puck.

10. The method of claim 9, further comprising:

applying a drywall compound to an exterior surface of the drywall panel surrounding the hole to cover the top surface of the cylindrical puck and the fastener.

* * * * *